US005167364A

United States Patent [19]

Wenning

[11] Patent Number: 5,167,364

[45] Date of Patent: Dec. 1, 1992

[54] ROTATABLE MOUNTING ASSEMBLY FOR A RURAL MAILBOX

[76] Inventor: Joseph R. Wenning, 22 Fairway La., Ocean, N.J. 07712

[21] Appl. No.: 856,720

[22] Filed: Mar. 24, 1992

[51] Int. Cl.[5] ..... B65D 91/00

[52] U.S. Cl. ..... 232/39; 248/145; 248/417

[58] Field of Search ..... 232/39; 248/145, 417, 248/425

[56] References Cited

U.S. PATENT DOCUMENTS

| | | | |
|---|---|---|---|
| 1,004,476 | 9/1911 | Schultz | 248/145 |
| 1,386,621 | 8/1921 | Hughes | 248/417 |
| 1,584,085 | 5/1926 | England . | |
| 1,753,506 | 4/1930 | Florine . | |
| 1,759,314 | 5/1930 | Kinquist | 248/145 |
| 1,893,392 | 1/1933 | Black | 248/145 |
| 1,897,676 | 2/1933 | Ries | 248/417 |
| 2,050,573 | 8/1936 | Kammerich | 248/145 |
| 2,079,510 | 5/1937 | King et al. . | |
| 2,147,890 | 2/1939 | Glasgow | 248/145 |
| 2,216,408 | 10/1940 | Elmer | 248/145 |
| 3,223,376 | 12/1965 | Ciuffini | 248/417 |
| 3,367,613 | 2/1968 | Christensen | 248/145 |
| 3,802,656 | 4/1974 | Virblas . | |
| 3,999,702 | 12/1976 | Conroy . | |
| 4,667,918 | 5/1987 | Page . | |
| 4,995,576 | 2/1991 | Kieswetter | 248/145 |

*Primary Examiner*—Renee S. Luebke
*Assistant Examiner*—Michael J. Milano
*Attorney, Agent, or Firm*—Sughrue, Mion, Zinn, Macpeak & Seas

[57] ABSTRACT

A rotatable support assembly which may be easily attached directly to an existing regulation-type mailbox and to an existing ground post for the mailbox. The mailbox is attached to the top surface of an inner sleeve which is telescopically inserted in an outer sleeve. Inwardly projecting from the outer sleeve is a fixed cam follower on which travels an upwardly curved camming slot formed in the wall of the inner sleeve and spanning a horizontal angle of 180°. Thus, the follower and slot are both concealed from view and also are protected from damage by external forces. In the normal mail-receiving position of the mailbox, the upper end of the camming slot rests on the cam follower, and the mailbox points toward the road to facilitate the delivery of mail. A simple spring-loaded lock may be provided to maintain the mailbox in this normal position. When a person wishes to retrieve mail from the mailbox, the person merely applies a turning force to the mailbox to rotate the inner sleeve so that the camming slot travels on the cam follower, thereby elevating the mailbox and rotating it through an angle of 180°, i.e., until the lower end of the camming slot temporarily rests on the fixed cam follower, so that the mail may be removed therefrom. Upon releasing or slight pushing of the mailbox, it returns by gravity to its normal position. The concealed construction is aesthetically attractive and also prevents injury to small children and damage to a person's clothing.

24 Claims, 2 Drawing Sheets

ROTATABLE MOUNTING ASSEMBLY FOR A RURAL MAILBOX

BACKGROUND OF THE INVENTION

My invention generally relates to rotatable mailboxes and, more particularly, to a rotatable mailbox-supporting assembly which is inexpensive and which can be easily attached to an existing mailbox ground post and to an existing rural mailbox of the type which is approved by the U.S. Postal Service.

Statistics show that thousands of injuries occur annually to persons while retrieving their mail from rural mailboxes located along the side of a road. Present designs of fixed, non-rotatable mailbox assemblies, while facilitating the delivery of mail, disregard the physical danger to a person who must step into the road and into traffic in order to open the mailbox and retrieve the mail from the inside of the mailbox. Thus, there is a need for a means for mounting such a mailbox so that the mail can be retrieved therefrom without a person's having to step in front of the mailbox and into the road, while at the same time allowing for the use of a regulation-type mailbox which is in current use and which is approved by the U.S. Postal Service.

Even though I am unaware of any commercially available rotatable assemblies for mounting rural mailboxes, rotatable mailboxes, per se, have been described in the prior art. For example, U.S. Pat. No. 1,584,085—England discloses a mailbox support consisting of a horizontally-extending arm having a mailbox mounted on the bottom surface of the outer end of the arm; the horizontal arm is telescopically mounted within a horizontal pipe section which is connected via an elbow to an outer sleeve telescoped on a post inserted in the ground; fixed to the post is a roller which travels in a curved slot formed in the outer sleeve, thereby permitting the horizontal arm to be elevated and to be rotated through an angle of only 90°. U.S. Pat. No. 3,999,702—Conroy shows a rotatable mailbox mounted on the top surface of a horizontally extending arm which is fixed to an inner tubular member telescopically inserted in an outer tubular ground post; a pin fixed to the inner tubular member rides on an inclined cam surface of the ground post so that the horizontal arm can be elevated and rotated through an angle of 180°; alteratively, the ground post can be telescopically inserted into the tubular member, in which case the pin would project inwardly and ride on an interior camming surface of the post. U.S. Pat. Nos. 2,079,510—King et al, 1,753,506—Florine, 1,893,392—Black and 3,802,656—Virblas also show a mailbox mounted on the outer end of a horizontally extending arm whose inner end is mounted on a vertical post having telescopic tubular members which are rotatable through an angle of 180° or more via the action of camming surfaces. U.S. Pat. No. 4,667,918—Page discloses a rotatable mailbox pedestal on which a mailbox is directly mountable through an angle of 180°, but which has a complex bearing system and a complex key-operated locking mechanism.

SUMMARY OF THE INVENTION

The broad object of my invention is to provide a simple and inexpensive rotatable mounting assembly which may be easily added to an existing regulation-type rural mailbox and to an existing mailbox ground post.

Another object of my invention is to provide such a rotatable assembly in which the operative parts thereof are concealed from view, thereby protecting such parts from damage and also enhancing the aesthetic appearance of the assembly while at the same time providing a safety feature by eliminating projecting parts to prevent injury to persons and damage to person's clothing.

Another object of my invention is to provide such a rotatable assembly which is usable either with a square or a cylindrical support post inserted in the ground.

Another object is to provide such a rotatable assembly upon which a regulation mailbox may be directly mounted without any horizontal extension arm.

Still another object is to provide such a rotatable assembly having an inexpensive locking means for retaining a mounted mailbox in its normal position.

A further object is to provide such a rotatable assembly for mounting a mailbox for rotation through an angle of only 180°.

Another object of my invention is to provide, in combination, a mailbox, a ground post and a rotatable mounting assembly, coupled between the mailbox and the post, for permitting rotation of the mailbox through an angle of 180°.

DESCRIPTION OF PREFERRED EMBODIMENTS

Figure 1:
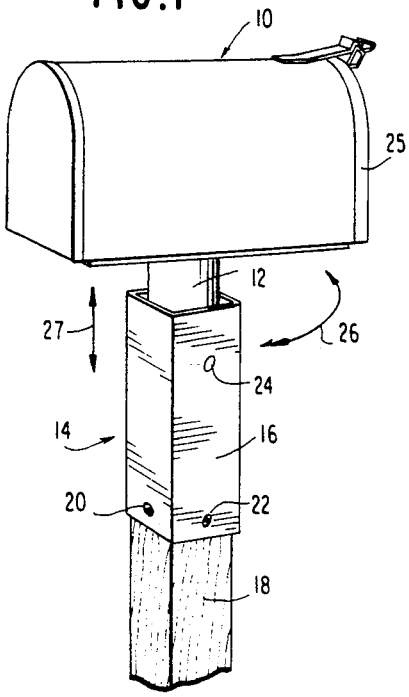
FIG. 1 is a perspective view of a first embodiment of the invention and shows the mailbox in its temporary mail-retrieving position which is elevated from, and rotated 180° from, the normal mail-receiving position of the mailbox.

FIG. 1 is a perspective view illustrating both a first embodiment of the invention and the basic configuration of my inventive concept of a rotatable mounting assembly connected between a mailbox and a ground post for the mailbox. More specifically, a mailbox 10 of the conventional type which is approved by the U.S. Postal Service is fixed to the top end of an inner cylindrical tubular member or sleeve 12 of my novel rotatable mounting assembly generally designated by the reference numeral 14. The inner tubular member 12 is telescopically inserted in an outer cylindrical tubular member or sleeve 16 which, in this embodiment, has a square cross-section so that it can be fixed to a conventional four-by-four ground post by four fastening screws such as screws 20 and 22. Reference numeral 24 designates the outer head of a cam follower pin which will later be described in more detail. In FIG. 1, the mailbox is illustrated as being in its elevated and rotated temporary position in which mail is to be retrieved through the mailbox door 25. In this position, the longitudinal dimension of the mailbox would be perpendicular to an adjoining roadway, with the door 25 facing away from the roadway. Arrow 26 indicates the angular rotations in a horizontal plane, and arrow 27 indicates the vertical displacements of the mailbox.

Figure 2:
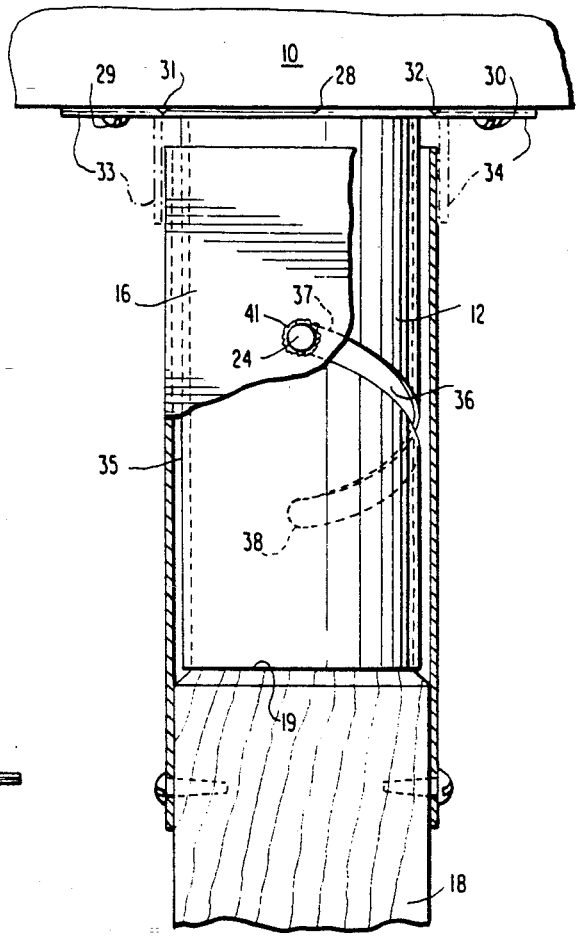
FIG. 2 is an elevational view, partly in cross-section, showing the mailbox in its normal lowered mail-receiving position.
Figure 3:
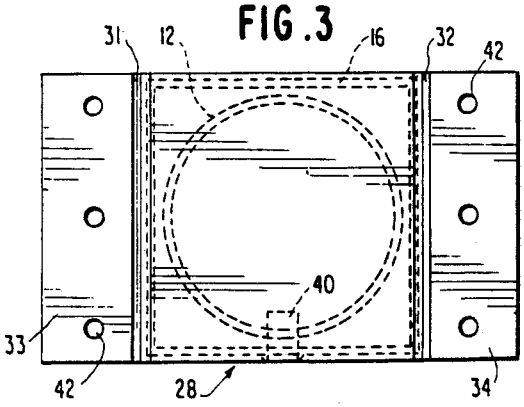
FIG. 3 is a top view of FIG. 2 without the mailbox.
Figure 4:
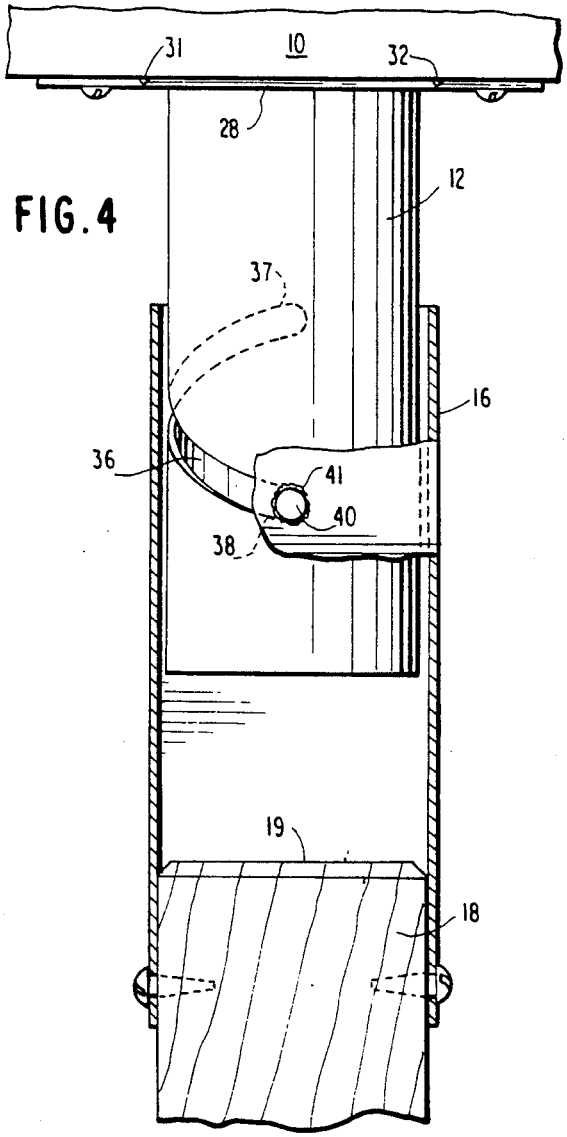
FIG. 4 is an elevational view, similar to FIG. 2, but showing the mailbox in its rotated and elevated temporary mail-retrieving position.

FIGS. 2, 3 and 4 illustrate in more detail the embodiment of FIG. 1 In FIG. 2, the mailbox 10 is illustrated in its normal lowered mail-receiving position in which the mailbox door 25 would be facing the roadway. FIG. 4 illustrates the mailbox in the same rotated and elevated position as shown in FIG. 1. Welded to the top of the inner cylindrical tubular member 12 is a mounting plate 28 which is removably secured to a bottom surface of the mailbox 10 by fasteners, such as screws 30 and 32. The mounting plate 28 may be made of plastic (PVC), metal (steel) or fiberglass and contains two V-shaped grooves or score lines 31, 32 which define foldable plate end portions 33 and 34, respectively. When my rotatable mounting assembly is shipped, these foldable end portions are folded downwardly (as shown in dot-dash lines in FIG. 2) for the sake of compactness. To secure the mounting plate 28 to the mailbox 10, one merely moves the plate end portions 33 and 34 upwardly to the horizontal position as shown in solid lines in FIGS. 2 and 3 and uses the fasteners, such as screws 29 and 30, to secure the plate to the bottom of the mailbox.

The wall of the inner tubular member 12 has a thickness indicated by the reference numeral 35. Cut through the wall 35 is a curved camming slot 36 which extends through a horizontal angle of 180° around the circumference of the inner tubular member 12 and which has an upper end 37 and a lower end 38. These upper and lower ends are vertically spaced apart by a sufficient distance such that, when the mailbox is manually held in the elevated and rotated temporary mail-retrieving position as illustrated in FIGS. 1 and 4, removal of the holding force will cause the inner tubular member 12, carrying the weight of the mailbox, to rotate in the opposite direction and return under the force of gravity to the lower normal mail-delivery position illustrated in FIG. 2.

A cam follower pin 40 is fixed, as by a weld 41, in a hole in the outer tubular member 16 and projects radially inwardly to extend through the camming slot 36 of the inner tubular member 12. As will be described below, the cam follower pin 40 may be removably secured to the outer tubular member 16 so that the tubular members 12 and 16 can be disassembled from each other.

FIG. 3 shows a top view of my rotatable mounting assembly and shows that the foldable end portions 33, 34 of the mounting plate 28 has a total of six holes 42 through which fasteners, such as the screws or bolts 29, 30, may be inserted for the purpose of securing the mailbox 10 directly to the mounting plate, i.e., without the need for any intervening components such as a horizontally extending support arm having an outer end on which the mailbox is mounted.

As most clearly shown in FIG. 2, the dimensions of the inner and outer tubular members 12 and 16 and of the camming slot 36 are chosen such that, for mechanical stability, the bottom of the inner tubular member 12 rests on the top surface 19 of the ground post 18 when the mailbox is in its normal lowered mail-receiving position.

Figure 5:
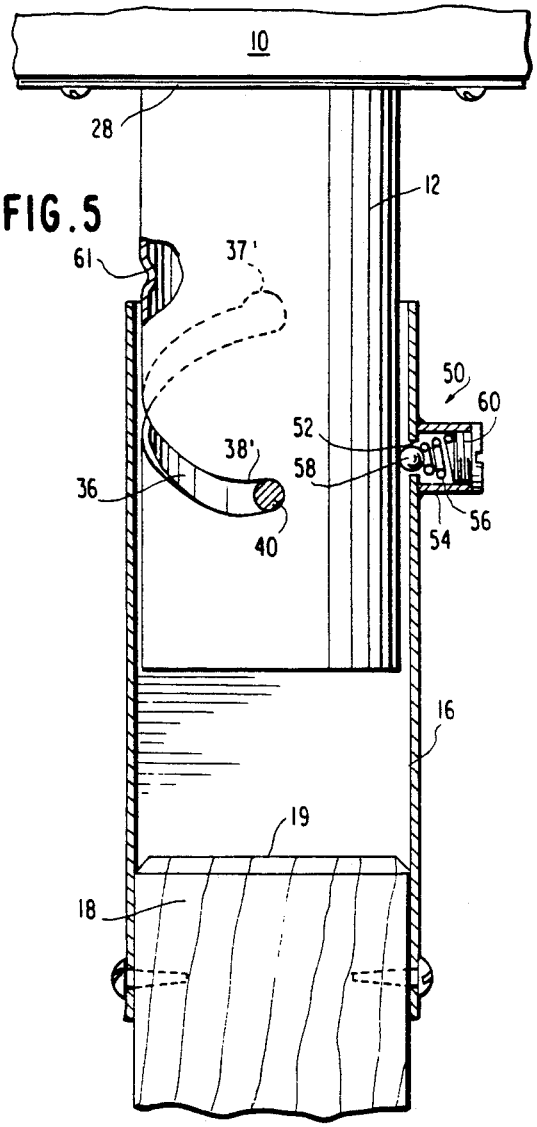
FIG. 5 is an elevational view, similar to FIG. 4, but showing various optional locking means for releasably locking the mailbox in its normal lowered mail-receiving position and/or in its elevated temporary mail-retrieving position.

FIG. 5 illustrates optional features of my invention and provides for locking the mailbox 10 in its normal lowered mail-receiving position and/or elevated mail-retrieving position to prevent undesired rotation of the mailbox.

For example, for locking in the lowered position, a spring-loaded locking mechanism 50 is located opposite a small circular opening 52 in and upper portion of the outer tubular member 16. An internally threaded housing 54 is welded to the outer tubular member 16 to surround the opening 52. Mounted in the housing 54 is a spring 56 and a ball bearing 58 which is biased radially inwardly by the spring to bear against the outer surface of the inner tubular member 12. The spring pressure may be adjusted by the adjusting screw 60. Formed in an upper portion of the outer wall of the inner tubular member 12 is an indentation 61 which is shaped to receive and engage the ball bearing 58 when the indentation 61 and ball bearing 58 are in vertical circumferential alignment. The relative positions of the ball bearing 58 and the indentation 61 are chosen so that such alignment (and the resulting locking action) occurs only when the mailbox and inner tubular sleeve 12 are in their lowered normal mail-receiving position. FIG. 5 illustrates the mailbox in its elevated temporary mail-retrieving position in which the indentation 61 is vertically displaced from the ball bearing 58 and also circumferentially displaced by an angle of 180°.

In the embodiment of FIG. 5, the lower end 38' of the camming slot 36 is optionally turned slightly upward toward the horizontal in order to provide a very slight frictional force which is sufficient to maintain the inner tubular sleeve 12 (carrying the mailbox 10) in the temporary elevated mail-retrieving position as illustrated in FIG. 5, thus providing hands-free operation when retrieving the mail from the mailbox. Only a slight push is required to cause the mailbox to return by gravity to its normal lower mail-receiving position. Similarly, the locking force provided by the locking mechanism 50 in the normal lower position is sufficiently small so that it can be easily overcome by a manually-applied opposite turning force to move the mailbox to its elevated temporary mail-retrieving position.

Furthermore, with or without the optional locking mechanism 50, the upper end 37' of the camming slot 36 may optionally also be provided with an upwardly extending notch or enlarged end opening to retain or lock the mailbox in its lowered position. Again, only a slight pushing and lifting force is required to cause the camming action to carry the mailbox to its elevated position.

Figure 6:
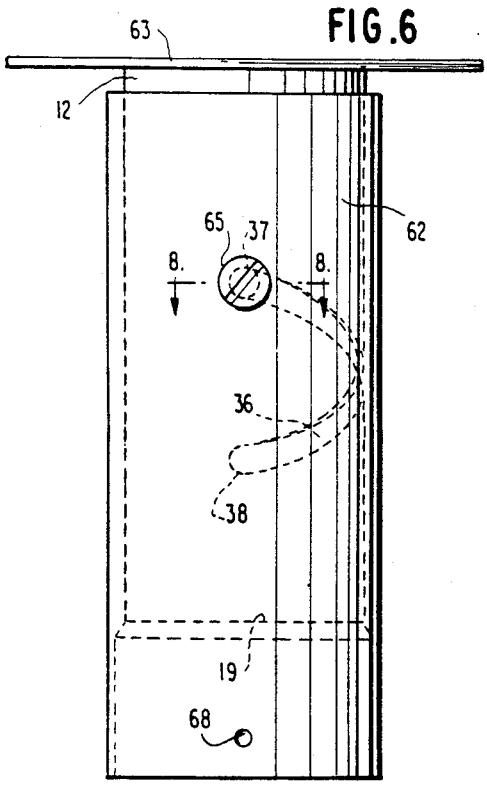
FIG. 6 is an elevational view of another embodiment of the invention, wherein both the inner and outer sleeves of the inventive rotatable mounting assembly are cylindrical.
Figure 7:
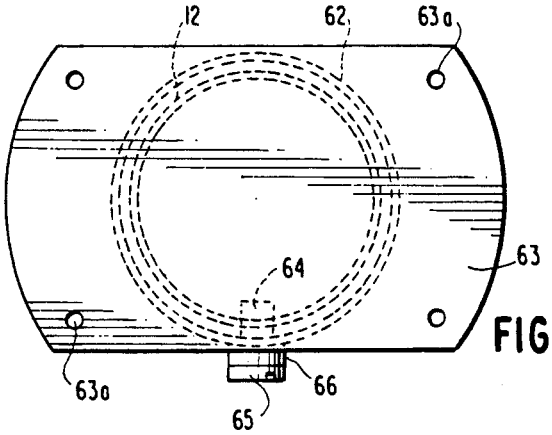
FIG. 7 is a top view of FIG. 6.
Figure 8:
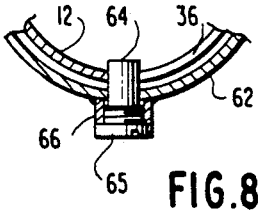
FIG. 8 is a cross-sectional view taken along line 8—8 of FIG. 6.

FIGS. 6, 7 and 8 illustrate other embodiments and/or optional features of my invention. As shown in these figures, the outer tubular member 62 is cylindrical and has a circular cross-section, like the inner tubular member 12. A mounting plate 63 of slightly different configuration is welded to the top end of the inner tubular member 12 and contains four screw holes **63*a*. Furthermore, in order to permit disassembly of the inner and outer tubular members 12 and 62 from each other, the cam follower pin 64 is in the form of a pin having a threaded shank 65 which is screwed into an internally threaded boss 66 (welded to the outer member 62 over an opening therein) until the follower pin 64 extends through the camming slot 36 in the inner tubular member 12. Alternatively, the follower pin 64 may be a nylon sleeve removably secured to the outer tubular member by a simple bold-and-nut arrangement, especially when the outer tubular member is square. Furthermore, the corresponding ground post also would be cylindrical with a circular cross-section to permit the outer tubular member 62 to be attached thereto by fasteners such as screws inserted through openings such as shown at 68. Otherwise, the construction and operation of the embodiment and variations illustrated in FIGS. 6, 7 and 8 are identical to those described for the embodiments shown in FIGS. 1–5**.

In operation, and once my novel rotatable supporting assembly has been secured to the mailbox and to the ground post, the mailbox will automatically rotate and gravitate to its normal lower mail-receiving position with the mailbox door facing the roadway. In order to retrieve mail from the mailbox, one merely manually rotates the mailbox through an angle of 180° to the elevated temporary mail-retrieving position, holds the mailbox in this temporary position while the mailbox door is opened so that the mail can be retrieved therefrom and then releases (or lightly pushes, for the FIG. 5 embodiment) the mailbox which will again rotate and gravitate back to its original normal position. When the mailbox is in its temporary position, the mailbox door faces away from the roadway, thereby eliminating the need for a person to step into the roadway in order to retrieve mail from the mailbox.

The inner and outer tubular members in all variations and embodiments of my invention may be made either of plastic (e.g., PVC), fiberglass or metal (e.g., steel). Even though the square ground post 18 is preferably a four-by-four wood post, it could also be made of these materials. The circular ground post for the embodiments of FIGS. 6–8 is preferably a metal tubular pipe, but it also may be solid, and it may be made of the same materials, including wood. The follower pin may be metal or plastic; however, in its preferred form, especially for a square outer tubular member, I prefer a nylon sleeve removably fixed to the outer tubular member by a simple bolt-and-nut arrangement. Furthermore, where I have stated that parts are welded together, such parts can be made integral with each other by well-known casting and/or molding processes, depending upon the materials used. Also, the peripheral location of the camming slot of the inner tubular member determines whether a clockwise or counterclockwise fuming force is required to rotate the mailbox from its normal lower mail-receiving position to its temporary elevated mail-retrieving position.

Furthermore, even though I have not illustrated all possible combinations and permutations of the various novel features of my invention, it is clear that one or more of the optional locking means 37', 38' and 50 shown in FIG. 5 can be applied to all of the embodiments and variations illustrated in FIGS. 1–4 and 6–8. Similarly, it is to be understood that the embodiments and/or variations and optional features illustrated in FIGS. 6–8 apply equally as well to the embodiments shown in FIGS. 1–5.

While I have described and illustrated various preferred embodiments and features of my invention, it is to be understood that obvious variations of my invention will become apparent to those of ordinary skill in the involved technology while still remaining within the spirit of the invention whose scope is limited only by the appended claims.

I claim:

1. An apparatus including a rotatable mounting assembly, adapted to be coupled between a horizontally oriented mailbox and a vertically oriented fixed ground post for the mailbox, for permitting horizontal rotation of the mailbox relative to the ground post, said mounting assembly comprising:

an outer tubular member adapted to be secured to the ground post; and a substantially cylindrical inner tubular member telescopically inserted into said outer tubular member and adapted to be secured to the mailbox;

said inner tubular member having a cylindrical wall containing an opening forming a curved camming slot which extends substantially 180° in a horizontal plane around the periphery of the cylindrical wall and which has opposite upper and lower ends which are vertically offset relative to one another;

said outer tubular member having secured thereto a radially inwardly extending cam member on which said camming slot travels, so that said inner tubular member rests, under the force of gravity, in a normal lower mail-receiving position in which said upper end of said camming slot is in engagement with said cam member, and so that, when there is applied to said inner tubular member a turning force in a horizontal plane, said inner tubular member rotates through a horizontal angle of 180°, as said camming slot travels on said cam member, and also moves upwardly until said lower end of said camming slot is in engagement with said cam member, to a temporary elevated mail-retrieving position, wherein said lower end of said camming slot extends in a horizontal direction so that said inner tubular member is frictionally retained in said temporary elevated mail-retrieving position.

2. The apparatus as defined in claim 1, further comprising:

first fastener means for fixing a lower portion of said outer tubular member to an upper portion of the ground post; and second fastener means for fixing an upper portion of said inner tubular member directly to a bottom surface of said mailbox.

3. The apparatus as defined in claim 1, wherein both said ground post and said outer tubular member have a square cross-section.

4. The apparatus as defined in claim 1, wherein both said ground post and said outer tubular member have a circular cross-section.

5. An apparatus as defined in claim 1, wherein said cam member is removably secured to said outer tube member to permit disassembly of said inner and outer tubular members.

6. The apparatus as defined in claim 5, wherein said outer tubular member has a peripheral wall containing a threaded opening, and wherein said cam member has a threaded portion for engaging said threaded opening, thereby removably fixing said cam member to said outer tubular member.

7. The apparatus as defined in claim 5, wherein said cam member is a nylon sleeve removably fixed to said outer tubular member by a bolt-and-nut arrangement.

8. The apparatus as defined in claim 1, further comprising locking means for releasably locking said inner tubular member in said normal mail-receiving position.

9. The apparatus as defined in claim 1, further comprising: a ground post fixed to a lower end of said outer tubular member; and a mailbox directly fixed to an upper end of said inner tubular member.

10. An apparatus as defined in claim 9, wherein said camming slot and said cam member have relative locations which cause a lower end of said inner tubular member to rest on a top end of the ground post when the mailbox is in said normal lower mail-receiving position.

11. The apparatus as defined in claim 1, wherein said inner tubular member has fixed to the top end thereof a planar mounting plate for securing the mailbox thereto, said mounting plate containing two spaced-apart folding grooves defining two plate end-portions which, for shipping purposes, are foldable in respective planes which are perpendicular to the plane of said planar mounting plate.

12. The apparatus as defined in claim 1, wherein the upper end of said camming slot has an upwardly extending slot for locking said inner tubular member in said normal lower position.

13. An apparatus including a rotatable mounting assembly, adapted to be coupled between a horizontally oriented mailbox and a vertically oriented fixed ground post for the mailbox, for permitting horizontal rotation of the mailbox relative to the ground post, said mounting assembly comprising:

an outer tubular member adapted to be secured to the ground post; and a substantially cylindrical inner tubular member telescopically inserted into said outer tubular member and adapted to be secured to the mailbox;

said inner tubular member having a cylindrical wall containing an opening forming a curved camming slot which extends substantially 180° in a horizontal plane around the periphery of the cylindrical wall and which has opposite upper and lower ends which are vertically offset relative to one another;

said outer tubular member having secured thereto a radially inwardly extending cam member on which said camming slot travels, so that said inner tubular member rests, under the force of gravity, in a normal lower mail-receiving position in which said upper end of said camming slot is in engagement with said cam member, and so that, when there is applied to said inner tubular member a turning force in a horizontal plane, said inner tubular member rotates through a horizontal angle of 180°, as said camming slot travels on said cam member, and also moves upwardly until said lower end of said camming slot is in engagement with said cam member, to a temporary elevated mail-retrieving position;

wherein the upper end of said camming slot has an upwardly extending slot for locking said inner tubular member in said normal lower position.

14. An apparatus including a rotatable mounting assembly, adapted to be coupled between a horizontally oriented mailbox and a vertically oriented fixed ground post for the mailbox, for permitting horizontal rotation of the mailbox relative to the ground post, said mounting assembly comprising:

an outer tubular member adapted to be secured to the ground post; and a substantially cylindrical inner tubular member telescopically inserted into said outer tubular member and adapted to be secured to the mailbox;

said inner tubular member having a cylindrical wall containing an opening forming a curved camming slot which extends substantially 180° in a horizontal plane around the periphery of the cylindrical wall and which has opposite upper and lower ends which are vertically offset relative to one another;

said outer tubular member having secured thereto a radially inwardly extending cam member on which said camming slot travels, so that said inner tubular member rests, under the force of gravity, in a normal lower mail-receiving position in which said upper end of said camming slot is in engagement with said cam member, and so that, when there is applied to said inner tubular member a turning force in a horizontal plane, said inner tubular member rotates through a horizontal angle of 180°, as said camming slot travels on said cam member, and also moves upwardly until said lower end of said camming slot is in engagement with said cam member, to a temporary elevated mail-retrieving position; and further comprising:

first fastener means for fixing a lower portion of said outer tubular member to an upper end portion of the ground post; and second fastener means for fixing an upper portion of said inner tubular member directly to a bottom surface of said mailbox.

15. An apparatus including a rotatable mounting assembly, adapted to be coupled between a horizontally oriented mailbox and a vertically oriented fixed ground post for the mailbox, for permitting horizontal rotation of the mailbox relative to the ground post, said mounting assembly comprising:

an outer tubular member adapted to be secured to the ground post; and a substantially cylindrical inner tubular member telescopically inserted into said outer tubular member and adapted to be secured to the mailbox;

said inner tubular member having a cylindrical wall containing an opening forming a curved camming slot which extends substantially 180° in a horizontal plane around the periphery of the cylindrical wall and which has opposite upper and lower ends which are vertically offset relative to one another;

said outer tubular member having secured thereto a radially inwardly extending cam member on which said camming slot travels, so that said inner tubular member rests, under the force of gravity, in a normal lower mail-receiving position in which said upper end of said camming slot is in engagement with said cam member, and so that, when there is applied to said inner tubular member a turning force in a horizontal plane, said inner tubular member rotates through a horizontal angle of 180°, as said camming slot travels on said cam member, and also moves upwardly until said lower end of said camming slot is in engagement with said cam member, to a temporary elevated mail-retrieving position;

wherein said tubular member has fixed to the top end thereof a planar mounting plate for securing the mailbox thereto, said mounting plate containing two spaced-apart folding grooves defining two plate end-portions which, for shipping purposes, are foldable in respective planes which are perpendicular to the plane of said planar mounting plate.

16. An apparatus comprising a horizontally oriented mailbox, a vertically oriented fixed ground post for the mailbox, and a rotatable mounting assembly for permitting horizontal rotation of the mailbox relative to the ground post, said mounting assembly comprising:

an outer tubular member secured to the ground post; and a substantially cylindrical inner tubular member telescopically inserted into said outer tubular member and secured to the mailbox;

said inner tubular member having a cylindrical wall containing a curved camming slot which extends substantially 180° in a horizontal plane around the periphery of the cylindrical wall and which has opposite upper and lower ends which are vertically offset relative to one another; and said outer tubular member having secured thereto a radially inwardly extending cam member on which said camming slot travels, so that said inner tubular member rests, under the force of gravity, in a normal lower position in which said upper end of said camming slot is in engagement with said cam member, and so that, when there is applied to said inner tubular member a turning force in a horizontal plane, said inner tubular member both rotates through a horizontal angle of 180°, as said camming slot travels on said cam member, and also moves upwardly until said lower end of said camming slot is in engagement with said cam member, to a temporary elevated mail-retrieving position;

said apparatus further comprising first fastener means for fixing a lower portion of said outer tubular member to an upper portion of the ground post; and second fastener means for fixing an upper portion of said inner tubular member directly to a bottom surface of said mailbox;

wherein said cam member is removably secured to said outer tube member to permit disassembly of said inner and outer tubular members;

wherein said outer tubular member has a peripheral wall containing a threaded opening, and wherein said cam member has a threaded portion for engaging said threaded opening, thereby removably fixing said cam member to said outer tubular member;

said apparatus further comprising locking means for releasably locking said inner tubular member in said normal mail-receiving position;

wherein said locking means comprises, in an upper portion of a wall of said outer tubular member, an inwardly spring-biased detent member, and wherein the cylindrical wall of said inner tubular member contains an indentation for receiving and engaging said detent member;

wherein said detent member and said indentation have relative locations on said outer and inner tubular members, respectively, such that said indentation receives and engages said detent member only when said inner tubular member is in said normal mail-receiving position; .

wherein said relative locations are displaced by an angle of 180° in a horizontal plane when said inner tubular member is in said temporary mail-retrieving position; and wherein said locking means comprises a spring-loaded ball bearing which is removably secured in an aperture in said wall of said outer member and which rides on an outer surface of such cylindrical wall of said inner tubular member except when said ball bearing is engaged in said indentation.

17. The apparatus as defined in claim 16, further comprising:

first fastener means for fixing a lower portion of said outer tubular member to an upper portion of the ground post; and second fastener means for fixing an upper portion of said inner tubular member directly to a bottom surface of said mailbox.

18. The apparatus as defined in claim 16, wherein both said ground post and said outer tubular member have a square cross-section.

19. An apparatus as defined in claim 16, wherein said camming slot and said cam member have relative locations which cause a lower end of said inner tubular member to rest on a top end of the ground post when the mailbox is in said normal lower mail-receiving position.

20. The apparatus as defined in claim 16, wherein said inner tubular member has fixed to the top end thereof a planar mounting plate for securing the mailbox thereto, said mounting plate containing two spaced-apart folding grooves defining two plate end-portions which, for shipping purposes, are foldable in respective planes which are perpendicular to the plane of said planar mounting plate.

21. An apparatus including a rotatable mounting assembly, adapted to be coupled between a horizontally oriented mailbox and a vertically oriented fixed ground post for the mailbox, for permitting horizontal rotation of the mailbox relative to the ground post, said mounting assembly comprising:

an outer tubular member adapted to be secured to the ground post; and a substantially cylindrical inner tubular member telescopically inserted into said outer tubular member and adapted to be secured to the mailbox;

said inner tubular member having a cylindrical wall containing an opening forming a curved camming slot which extends substantially 180° in a horizontal plane around the periphery of the cylindrical wall and which has opposite upper and lower ends which are vertically offset relative to one another;

said outer tubular member having secured thereto a radially inwardly extending cam member on which said camming slot travels, so that said inner tubular member rests, under the force of gravity, in a normal lower mail-receiving position in which said upper end of said camming slot is in engagement with said cam member, and so that, when there is applied to said inner tubular member a turning force in a horizontal plane, said inner tubular member rotates through a horizontal angle of 180°, as said camming slot travels on said cam member, and also moves upwardly until said lower end of said camming slot is in engagement with said cam member, to a temporary elevated mail-retrieving position, and further comprising:

locking means for releasably locking said inner tubular member in said normal mail-receiving position, wherein said locking means comprises, in an upper portion of a wall of said outer tubular member, inwardly spring-biased detent member, and wherein the cylindrical wall of said inner tubular member contains an indentation for receiving and engaging said detent member.

22. The apparatus as defined in claim 21, wherein said detent member and said indentation have relative locations on said outer and inner tubular members, respectively, such that said indentation receives and engages said detent member only when said inner tubular member is in said normal mail-receiving position.

23. The apparatus as defined in claim 22, wherein said relative locations are displaced by an angle of 180° in a horizontal plane when said inner tubular member is in said temporary elevated mail-retrieving position.

24. The apparatus as defined in claim 23, wherein said locking means comprises a spring-loaded ball bearing which is removably secured in an aperture in said wall of said outer tubular member and which rides on an outer surface of said cylindrical wall of said inner tubular member except when said ball bearing is engaged in said indentation.

* * * * *